US011585150B1

(12) United States Patent
Campbell

(10) Patent No.: US 11,585,150 B1
(45) Date of Patent: Feb. 21, 2023

(54) SECURITY INSULATED GLASS UNIT

(71) Applicant: Bradley R Campbell, Huntington Beach, CA (US)

(72) Inventor: Bradley R Campbell, Huntington Beach, CA (US)

( * ) Notice: Subject to any disclaimer, the term of this patent is extended or adjusted under 35 U.S.C. 154(b) by 0 days.

(21) Appl. No.: 17/525,645

(22) Filed: Nov. 12, 2021

(51) Int. Cl.

| | |
|---|---|
| ***E06B 3/663*** | (2006.01) |
| ***E06B 5/11*** | (2006.01) |
| ***E06B 3/26*** | (2006.01) |
| ***E06B 3/54*** | (2006.01) |
| ***E06B 3/62*** | (2006.01) |
| *E06B 3/67* | (2006.01) |

(52) U.S. Cl.
CPC ..... *E06B 5/11* (2013.01); *E06B 3/26* (2013.01); *E06B 3/549* (2013.01); *E06B 3/62* (2013.01); *E06B 3/66319* (2013.01); *E06B 3/66352* (2013.01); *E06B 3/66361* (2013.01); *E06B 3/6715* (2013.01); *E06B 2003/6638* (2013.01)

(58) Field of Classification Search
CPC ..... E06B 3/66352; E06B 3/66319; E06B 3/66361; E06B 3/6715; E06B 3/663; E06B 3/66309; E06B 3/66314; E06B 3/66328; E06B 3/66342; E06B 3/66366; E06B 3/67317; E06B 5/11; E06B 5/12; E06B 2003/66385; E06B 2003/66395
USPC ..... 52/786.13
See application file for complete search history.

(56) References Cited

U.S. PATENT DOCUMENTS

| | | | | | |
|---|---|---|---|---|---|
| 5,466,534 | A * | 11/1995 | Newby | E06B 3/66314 | 428/35.8 |
| 5,487,937 | A * | 1/1996 | Newby | E06B 3/667 | 428/317.1 |
| 5,512,341 | A * | 4/1996 | Newby | E06B 3/66314 | 428/35.8 |
| 6,192,652 | B1 * | 2/2001 | Goer | E06B 3/66328 | 52/786.13 |
| 7,757,455 | B2 * | 7/2010 | Gallagher | E06B 3/67308 | 52/204.705 |
| 2006/0201105 | A1 * | 9/2006 | Kato | C03C 27/06 | 52/786.13 |
| 2007/0227097 | A1 * | 10/2007 | Gallagher | E06B 3/66314 | 52/786.13 |
| 2008/0134596 | A1 * | 6/2008 | Brunnhofer | E06B 3/66319 | 52/786.13 |

(Continued)

*Primary Examiner* — Kyle J. Walraed-Sullivan
(74) *Attorney, Agent, or Firm* — Cionca IP Law P.C.; Marin Cionca

(57) ABSTRACT

An insulated glass unit having: an outer lite, an inner lite, and a shock absorbing spacer bar disposed between perimeter portions of the inner and outer lite, forming a cavity, the spacer bar having: an inner housing with a plurality of desiccant ports disposed between an internal desiccant chamber and the cavity; a desiccant encased within the desiccant chamber; a flexible outer housing in which the inner housing is nested; and a perimeter guard disposed on the outer surface of the spacer bar, said perimeter guard being configured to attach the spacer bar to each lite. The spacer bar is configured to be highly crush resistant, thus preventing the either lite from being dislodged during a forced entry attempt. The desiccant ports expose the desiccant to the cavity for humidity maintenance within said cavity. An additional lite and spacer bar may be implemented to form a three lite IGU.

17 Claims, 6 Drawing Sheets

(56) References Cited

U.S. PATENT DOCUMENTS

| | | | | |
|---|---|---|---|---|
| 2013/0212957 | A1* | 8/2013 | Cempulik | E04C 1/42 52/204.595 |
| 2016/0138326 | A1* | 5/2016 | Kuster | E06B 3/66366 52/204.595 |
| 2017/0298680 | A1* | 10/2017 | Schreiber | E06B 3/66314 |
| 2017/0321472 | A1* | 11/2017 | Frank | E06B 3/66366 |
| 2017/0321473 | A1* | 11/2017 | Frank | E06B 3/66352 |
| 2018/0340365 | A1* | 11/2018 | Kuster | E06B 3/025 |
| 2018/0344053 | A1* | 12/2018 | Schreiber | E06B 3/66371 |
| 2019/0383087 | A1* | 12/2019 | Hermens | E06B 3/67326 |
| 2020/0300029 | A1* | 9/2020 | Hervieux | E06B 3/66352 |
| 2020/0324451 | A1* | 10/2020 | Kuster | B29C 48/12 |
| 2021/0381303 | A1* | 12/2021 | Neander | E06B 3/66352 |

* cited by examiner

SECURITY INSULATED GLASS UNIT

This application relates to U.S. Non-Provisional application Ser. No. 17/525,545 filed Nov. 12, 2021, which is hereby incorporated by reference, to the extent that it is not conflicting with the present application.

BACKGROUND OF INVENTION

1. Field of the Invention

The invention relates generally to insulated glass units and specifically to insulated glass units configured for use in security applications.

2. Description of the Related Art

The usage of insulated glass units (IGUs) as window glazing solutions may be desirable for a variety of reasons. One notable feature of IGUs is that they may provide greater insulative properties than a singular pane/panel, due in part to the space disposed between their inner lite and outer lite ("pane", "panel") of said IGUs. For security applications, laminated glass may be used for one or more lites within an IGU. While laminated glass may be resistant to being broken, it may still be shattered by an individual striking it with a heavy tool or other destructive implement. Another issue that arises when using an IGU for security applications is that a rigid spacer that exists between the two lites of the IGU may be crushed, causing the IGU to weaken, allowing each lite to loosen and be dislodged without needing to break them. This crushing of the spacer may lead to the failure of the IGU and allowance unauthorized access through the failed IGU.

Therefore, there is a need to provide an insulated glass unit that overcomes the shortcomings listed hereinabove.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, a security insulated glass unit is provided, the security insulated glass unit comprising: an inner lite; an outer lite; and a shock absorbing spacer bar secured between perimeter portions of the inner lite and the outer lite, wherein a cavity is formed between the inner lite and the outer lite, the spacer bar comprising: an inner housing having a wider top surface, a narrower bottom surface, two upper side surfaces, each upper side surface connected to an opposite side of the wider top surface, two lower side surfaces, each lower side surface connected to an opposite side of the narrower bottom surface and a corresponding upper side surface, wherein the wider top surface, the two upper side surfaces, the two lower side surfaces and the narrower bottom surface form a tapered hexagonally shaped body, and the wider top surface and the narrower bottom surface are parallel with each other; a desiccant chamber encased within the hexagonally shaped body, and a plurality of desiccant ports that travel through the wider top surface; a desiccant material encased within the desiccant chamber, wherein the desiccant is exposed to the cavity through the desiccant ports; an outer housing comprising an outer housing base disposed between two outer housing legs and an inner housing slot nested between said outer housing legs, wherein each outer housing leg has of an angled section connected to the outer housing base, a straight section connected to the angled section and a locking ridge connected to the straight section, wherein the outer housing has a tapered shape and the inner housing is configured to nest within the inner housing slot and be secured within it through engagement of the wider top surface with the locking ridges; an inner adhesive spacer strip configured to be confined between and adhered to the inner lite and a corresponding straight section of the outer housing; an outer adhesive spacer strip configured to be confined between and adhered to the outer lite and a corresponding straight section of the outer housing; and a perimeter guard disposed on an outer perimeter of the spacer bar, the perimeter guard having a base surface disposed between two side ridges, wherein the outer housing is configured to be seated within the perimeter guard such that the outer housing base is in contact with the base surface and each side ridge is in contact with a corresponding angled section and the perimeter guard is configured to adhere the outer housing to the inner lite and the outer lite to seal the formed cavity, wherein the outer lite is made of a breakage resistant material and the spacer bar is configured to absorb the shock of an impact to the outer lite and insulate the formed cavity. One advantage is that by utilizing a shock absorbing spacer bar having an outer housing and perimeter guard made of flexible materials, the spacer bar may avoid being crushed during a forced entry attempt, thus preventing a potential failure mechanism for the security IGU. Another advantage to the shock absorbing spacer bar is that it helps the outer lite to resist an impact more flexibly by allowing said outer lite to move when struck, rather than remaining in place, while also preventing the full force of the impact from being exerted on the inner lite. Another advantage is that while the outer lite may be made of a material such as polycarbonate and may become scratched or scored from a forced entry attempt, said outer lite is highly breakage resistant, and thus may be replaced at leisure of the owner without compromising security. Another advantage is that the disclosed IGU is a monolithic element and may only require a singular mounting location to suitably attach it to a desired structure. Another advantage is the security IGU may be provided with an optimally minimized thickness wherein the outer lite is highly breakage resistant to prevent security IGU damage and the inner lite is configured to be scratch resistant. Another advantage is that the IGU may facilitate the usage of low emissivity, low iron, tinted, one way mirror or energy efficiency enabling materials for the inner lite, as a result of said IGU being capable of using glass as a material for the inner lite, while being able to prevent its breakage from a forced entry attempt.

In another aspect, a security insulated glass unit is provided, the security insulated security glass unit comprising: an inner lite; a middle lite; an outer lite; a first spacer bar disposed between perimeter portions of the inner lite and the middle lite, wherein an inner cavity is formed between the inner lite and the middle lite, said first spacer bar having: a first inner housing having a first desiccant chamber and a first plurality of desiccant ports disposed between the first desiccant chamber and the first inner cavity; a first desiccant material encased within the first desiccant chamber; a first outer housing, wherein the first inner housing is configured to nest within the first outer housing; a first inner adhesive spacer strip configured to be confined between and adhered to the inner lite and the first outer housing of the first spacer bar; a first outer adhesive spacer strip configured to be confined between and adhered to the middle lite and the first outer housing of the first spacer bar; and a first perimeter guard disposed on a first outer perimeter of the first spacer bar, wherein the first perimeter guard is configured to adhere the first outer housing of the first spacer bar to the inner lite and the middle lite to seal the formed inner cavity; and a second spacer bar disposed between perimeter portions of the middle lite and the outer lite, wherein an outer cavity is formed between the middle lite and the outer lite, said second spacer bar having: a second inner housing having a second desiccant chamber and a second plurality of desiccant ports disposed between the second desiccant chamber and the second outer cavity; a second desiccant material encased within the second desiccant chamber; a second outer housing, wherein the second inner housing is configured to nest within the second outer housing; a second outer adhesive spacer strip configured to be confined between and adhered to the outer lite and the second outer housing of the second spacer bar; a second inner adhesive spacer strip configured to be confined between and adhered to the middle lite and the second outer housing of the second spacer bar; and a second perimeter guard disposed on a second outer perimeter of the second spacer bar, wherein the second perimeter guard is configured to adhere the second outer housing of the second spacer bar to the middle lite and the outer lite to seal the formed outer cavity, wherein the outer lite is made of a breakage resistant material and the first spacer bar and the second spacer bar are configured to absorb the shock of an impact to the outer lite and insulate the inner cavity and outer cavity, respectively. Again, an advantage is that by utilizing shock absorbing spacer bars having outer housings and perimeter guards made of flexible materials, the spacer bars may avoid being crushed during a forced entry attempt, thus preventing a potential failure mechanism for the security IGU. Another advantage to the shock absorbing spacer bars is that they help the outer lite to resist an impact more flexibly by allowing said outer lite to move when struck, rather than remaining in place, while also preventing the full force of the impact from being exerted on the inner lite. Another advantage is that while the outer lite may be made of a material such as polycarbonate and may become scratched or scored from a forced entry attempt, said outer lite is highly breakage resistant, and thus may be replaced at leisure of the owner without compromising security. Another advantage is that the disclosed IGU is a monolithic element and may only require a singular mounting location to suitably attach it to a desired structure. Another advantage is the security IGU may be provided with an optimally minimized thickness wherein the outer lite is highly breakage resistant to prevent security IGU damage and the inner lite is configured to be scratch resistant. Another advantage is that the IGU may facilitate the usage of low emissivity, low iron, tinted, one way mirror or energy efficiency enabling materials for the inner lite and middle lite, as a result of said IGU being capable of using glass as a material for the inner lite and middle lite, while being able to prevent their breakage from a forced entry attempt. Another advantage is the utilization of an outer lite, an inner lite and a middle lite may increase the insulative capabilities of the IGU by providing more space between the inner lite and the outer lite.

In another aspect, a security insulated glass unit is provided, the security insulated glass unit comprising: an inner lite; an outer lite; a spacer bar secured between the inner lite and the outer lite, wherein a cavity is formed between the inner lite and the outer lite, the spacer bar comprising: an inner housing having a desiccant chamber and a plurality of desiccant ports disposed between the desiccant chamber and the cavity; a desiccant material encased within the desiccant chamber; an outer housing, wherein the inner housing is configured to nest within the outer housing; an inner spacer strip configured to be confined between the inner lite and the outer housing; an outer spacer strip configured to be confined between the outer lite and the outer housing; and a perimeter guard disposed on an outer perimeter of the spacer bar, wherein the perimeter guard is configured to adhere the outer housing to the inner lite and the outer lite to seal the formed cavity, wherein the outer lite is made of a breakage resistant material and the spacer bar is configured to absorb the shock of an impact to the outer lite and insulate the formed cavity. Again, an advantage is that by utilizing a shock absorbing spacer bar having an outer housing and perimeter guard made of flexible materials, the spacer bar may avoid being crushed during a forced entry attempt, thus preventing a potential failure mechanism for the security IGU. Another advantage to the shock absorbing spacer bar is that it helps the outer lite to resist an impact more flexibly by allowing said outer lite to move when struck, rather than remaining in place, while also preventing the full force of the impact from being exerted on the inner lite. Another advantage is that while the outer lite may be made of a material such as polycarbonate and may become scratched or scored from a forced entry attempt, said outer lite is highly breakage resistant, and thus may be replaced at leisure of the owner without compromising security. Another advantage is that the disclosed IGU is a monolithic element and may only require a singular mounting location to suitably attach it to a desired structure. Another advantage is the security IGU may be provided with an optimally minimized thickness wherein the outer lite is highly breakage resistant to prevent security IGU damage and the inner lite is configured to be scratch resistant. Another advantage is that the IGU may facilitate the usage of low emissivity, low iron, tinted, one way mirror or energy efficiency enabling materials for the inner lite, as a result of said IGU being capable of using glass as a material for the inner lite, while being able to prevent its breakage from a forced entry attempt.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
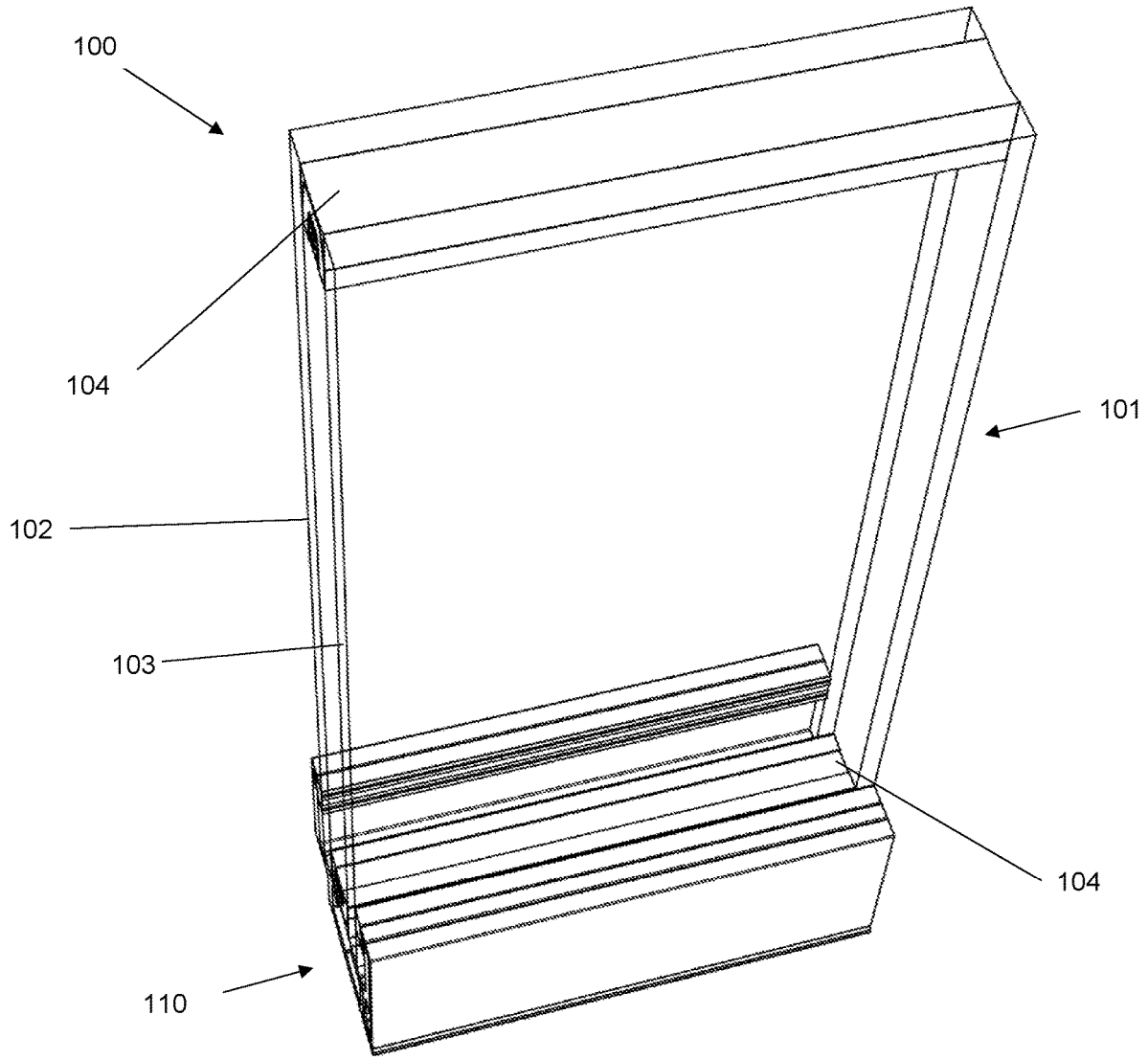
FIG. 1 illustrates the top perspective view of a window mounted Riot Glass security IGU, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 105 and 205, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 illustrates the top perspective view of a window 100 mounted Riot Glass security IGU 101, according to an aspect. The disclosed Riot Glass security insulated glass unit ("Riot Glass security IGU", "Riot Glass IGU", "RG IGU", "Security IGU" "IGU") 101 may be implemented within a window, door or other suitable structure in order to prevent forced entry through said structure. The RG IGU 101 may be comprised of an inner lite 103, an outer lite 102 and a security specific shock absorbing spacer bar ("shock absorbing spacer bar" "spacer bar") 104 disposed between the inner and outer lite. The outer lite 102 may be made of polycarbonate. Polycarbonate may be chosen as a desirable material for the outer lite 102 due in part to its high strength and durability, which will make it highly resistant to being broken. This is most desirable for the outer lite 102 due to the fact that the exterior side of the structure is the location from which a break-in would be attempted. By providing a durable outer lite 102 between the outside of an attached window 100 and the inner lite 103, said inner lite 103 may be protected from the majority of the force being imparted upon the IGU from the exterior environment.

The inner lite 103 may be made of a laminated glass. It is not nearly as critical to provide a breakage resistant inner lite 103 as it is to provide a breakage resistant outer lite 102, due to the fact that break-ins would only be attempted from the outer side of the IGU 101, thus only leaving the outer lite 102 exposed to direct impact. While the inner lite 103 may experience some strain from an impact experienced by the outer lite 102, this strain is reduced by the shock absorption of the spacer bar 104 and will typically be insufficient to affect the inner lite 103. The usage of a glass substrate for the inner lite 103 may allow for the utilization of specialty glasses or coatings, as will be discussed in greater detail hereinbelow. The inner lite 103 may also be made of a durable material, such as polycarbonate, based on the needs of the application. Both the inner lite 103 and the outer lite 102 may be provided with the same height and length, such that the only dimension they differ by is their depth. Each lite may be aligned within the IGU 101 such that they are parallel with each other. Upon addition of the spacer bar 104, the IGU may form a shape consistent with that of a right rectangular prism, said right rectangular prism having 3 sets of parallel faces and right angles between adjacent faces, wherein the largest set of parallel faces corresponds to the viewing surface of said IGU.

The spacer bar 104 may be disposed within the gap formed between the inner lite 103 and the outer lite 102. This spacer bar 104 may capture and adhere to the edges of each lite in order to form a unified, singular IGU 101. Said spacer bar 104 may also seal the gap disposed between the two lites, forming an IGU cavity 101*a*, ("cavity") as a result of being disposed between the respective perimeters portions of both lites. The spacer bar 104 may be made of a combination of different materials, such as metals, rubbers or any other suitable materials to provide a needed structural flexibility to the IGU 101. The spacer bar 104 may also be comprised of several different components, each of which will be discussed in greater detail hereinbelow.

As described above, the gap formed between the inner lite 103 and outer lite 102 may be sealed using the spacer bar 104, forming an air-tight IGU cavity 101*a*. An insulative gas, such as argon gas, may occupy the IGU cavity 101*a*. By filling the IGU cavity 101*a* with argon gas, or another suitable insulative gas, such as krypton gas, the IGU 101 may exhibit better insulative properties due to the lower thermal conductivity of said insulative gas when compared to air. Alternatively, a vacuum may be formed within the IGU cavity 101*a* during manufacturing. The superior insulation provided by such an IGU 101 having a trapped insulative gas may reduce heating costs and increase heating/cooling efficacy by impeding heat transfer through the IGU 101.

Figure 2:
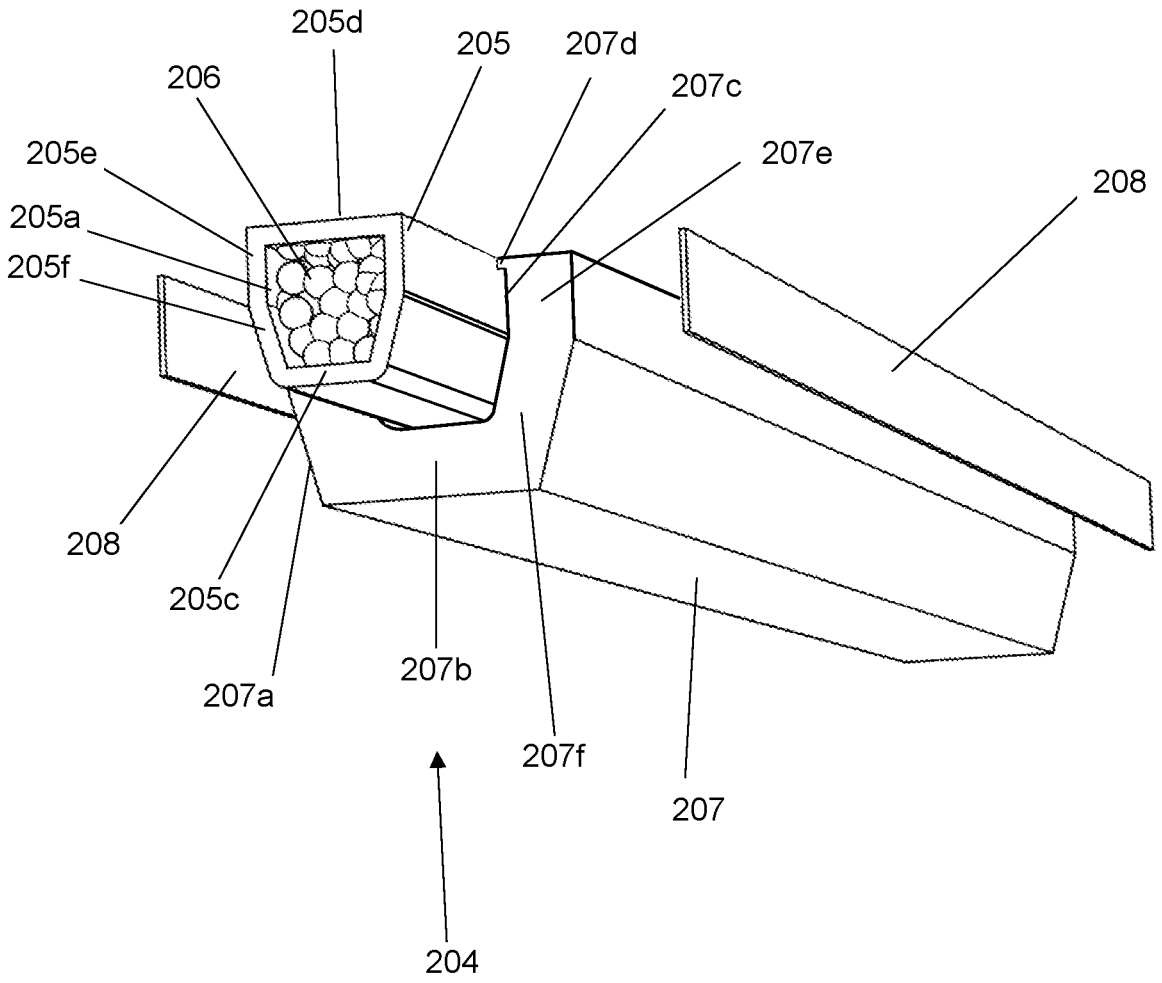
FIG. 2 illustrates the exploded view of the disclosed spacer bar, according to an aspect.

FIG. 2 illustrates the exploded view of the disclosed spacer bar 204, according to an aspect. The disclosed security specific shock absorbing spacer bar 204 may be disposed between the inner lite and the outer lite of a Riot Glass IGU in order to prevent said IGU from being crushed as the result of a break-in attempt. The spacer bar 204 may be comprised of an inner housing 205 nested within an outer housing 207, a desiccant 206 nested within the inner housing 205 and two spacer strips 208 disposed on opposite, lite adjoining side ends of the outer housing 207. A desiccant chamber 205*a* may be encased within the hollow center of the inner housing 205 to contain said desiccant 206. The inner housing may have a hexagonally shaped body with a narrower bottom surface 205*c* and a wider top surface 205*d*. While not visible from the depicted perspective, the inner housing 205 may be further comprised of a plurality of desiccant ports, such as desiccant ports 305*g* of FIG. 3A, embedded within the wider top surface 205*d*, in order to expose an internally held desiccant 206 to the IGU cavity. By having the desiccant ports disposed between the desiccant chamber 205*a* and the IGU cavity, the desiccant 206 may help keep said cavity free of moisture without itself being readily visible. The inner housing 205 may be made of metal, such as aluminum, and produced through forming rolled aluminum into the shape described above. The inner housing 205 may also be produced using other suitable manufacturing methods known in the industry, such as injection molding and extrusion. The described hexagonal shape increases the engagement areas between several components and will be discussed in more detail hereinbelow.

The desiccant 206 nested within the inner housing 205 may be any suitable desiccant for use within IGU based applications for maintaining the necessary humidity conditions within the IGU cavity. A common desiccant 206, such as silica gel, may be utilized as a simple and affordable desiccant 206 for many different installation environments. Other know desiccant materials may be utilized depending on the application needs and environmental conditions of the IGU 101. The desiccant may be produced using known desiccant production methods in the industry.

The outer housing 207 may be a tapered structure configured to have the inner housing 205 nest within it, such that the wider top surface 205*d* of said inner housing is exposed to the IGU cavity. The outer housing 207 may be comprised of an outer housing base 207*b* disposed between two outer housing legs 207*a*, such that an inner housing slot 207*c* is disposed between said outer housing legs 207*a*. The inner housing 205 is configured to fit within the inner housing slot 207*c* of the outer housing 207, wherein the inner housing slot 207*c* has a shape compatible to that of the inner housing 205. A locking ridge 207*d* extending from each housing leg 207*a* into the inner housing slot 207*c* may be configured to engage with the wider top surface 205*d* of the inner housing 205 to secure said inner housing 205 within the inner housing slot 207*c*. Upon the nesting of the inner housing 205 within the outer housing 207, the outer housing base 207*b* may be in direct contact with the narrower bottom surface 205*c* of the inner housing 205. The outer housing 207 may be made of rubber, such as closed cell EPDM, or another suitably flexible material that allows for the nesting of the inner housing 205 within it and provides flexible, shock-absorbing impact resistance.

The outer housing 207 may be the prime component of the spacer bar 204 responsible for providing crush resistance and shock absorption to the IGU. The outer housing 207 of the security specific shock absorbing spacer bar 204 may be comprised of a flexible material, such as closed cell EPDM rubber, that is capable of flexibly absorbing an impact applied to the outer lite of an IGU flexibly, thus reducing the likelihood of each component being damaged or crushed, accordingly. The outer housing 207 may provide a uniform thickness of said flexible material 11 around the majority of the inner housing 205, while still leaving the desiccant ports exposed to the IGU cavity. The outer housing 207 may be manufactured through suitable production methods known in the industry.

A spacer strip ("strip") 208 may be disposed adjacently to each outer housing leg 207*a*, such that upon installation of the spacer bar 204 between the inner lite and the outer lite, an inner spacer strip 208 is confined between the inner lite and a corresponding outer housing leg 207*a*, while an outer spacer strip 208 is confined between the outer lite and the other opposite housing leg 207*a*. The spacer strips 208 may also have adhesive properties, wherein the inner adhesive strip 208 is configured to adhere the inner lite to a corresponding housing leg 207*a* and the outer adhesive strip 208 is configured to adhere the outer lite to the opposite housing leg 207*a*. These spacer strips 208 may help to adhere the inner lite and outer lite to the outer housing 207 prior to formation of a perimeter guard, as well as help insulate the formed IGU cavity to prevent the leakage of an insulative gas stored within said cavity. Each spacer strip 208 may be made of rubber or another suitable material and be adhesive on both applicable surfaces of the strip to help create an airtight seal between each corresponding lite and the outer housing 207 of the spacer bar 204.

Figure 3A:
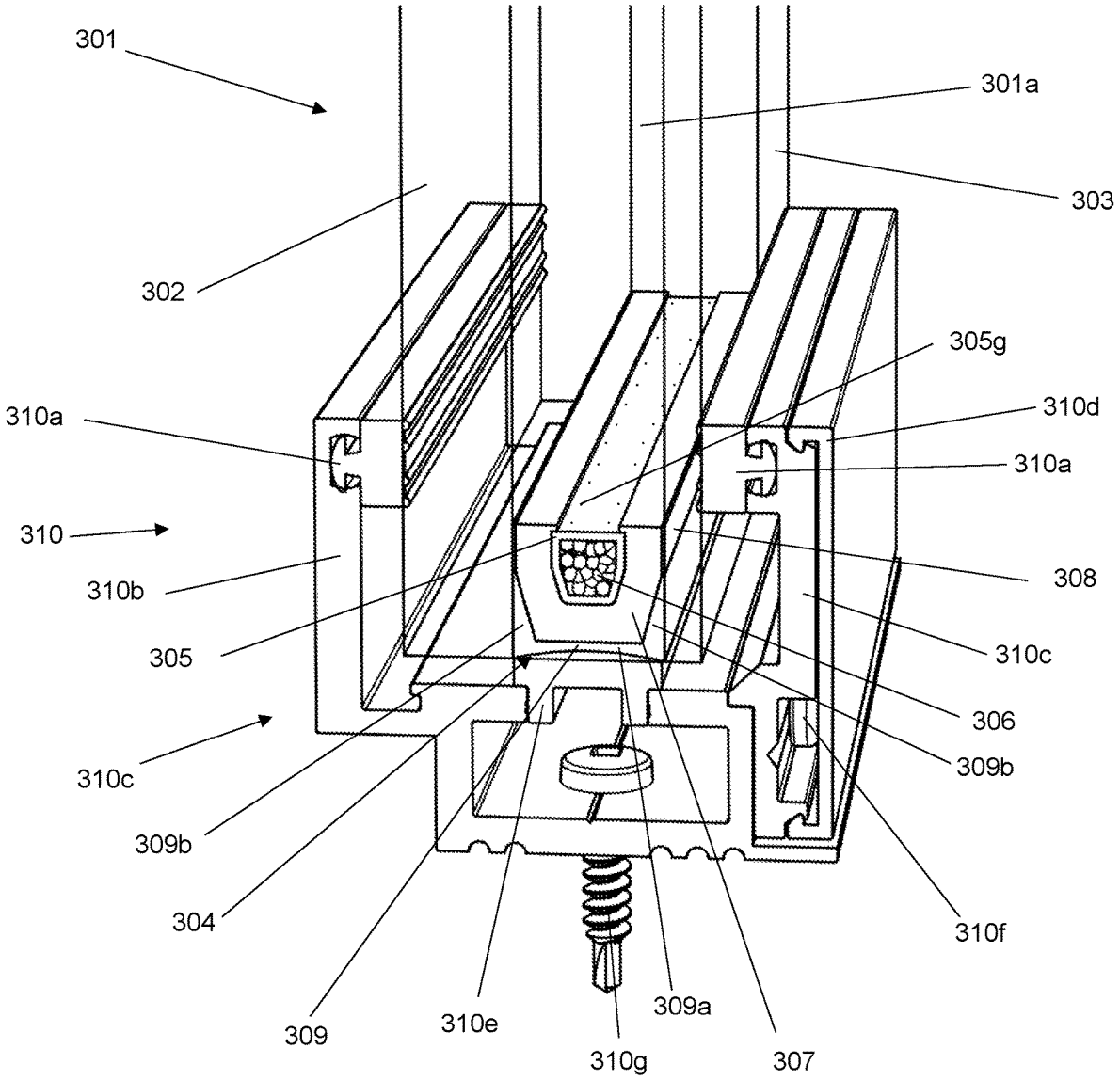
FIG. 3A and FIG. 3B illustrate the cross-sectional views of a mounted Riot Glass security IGU, according to an aspect.
Figure 3B:
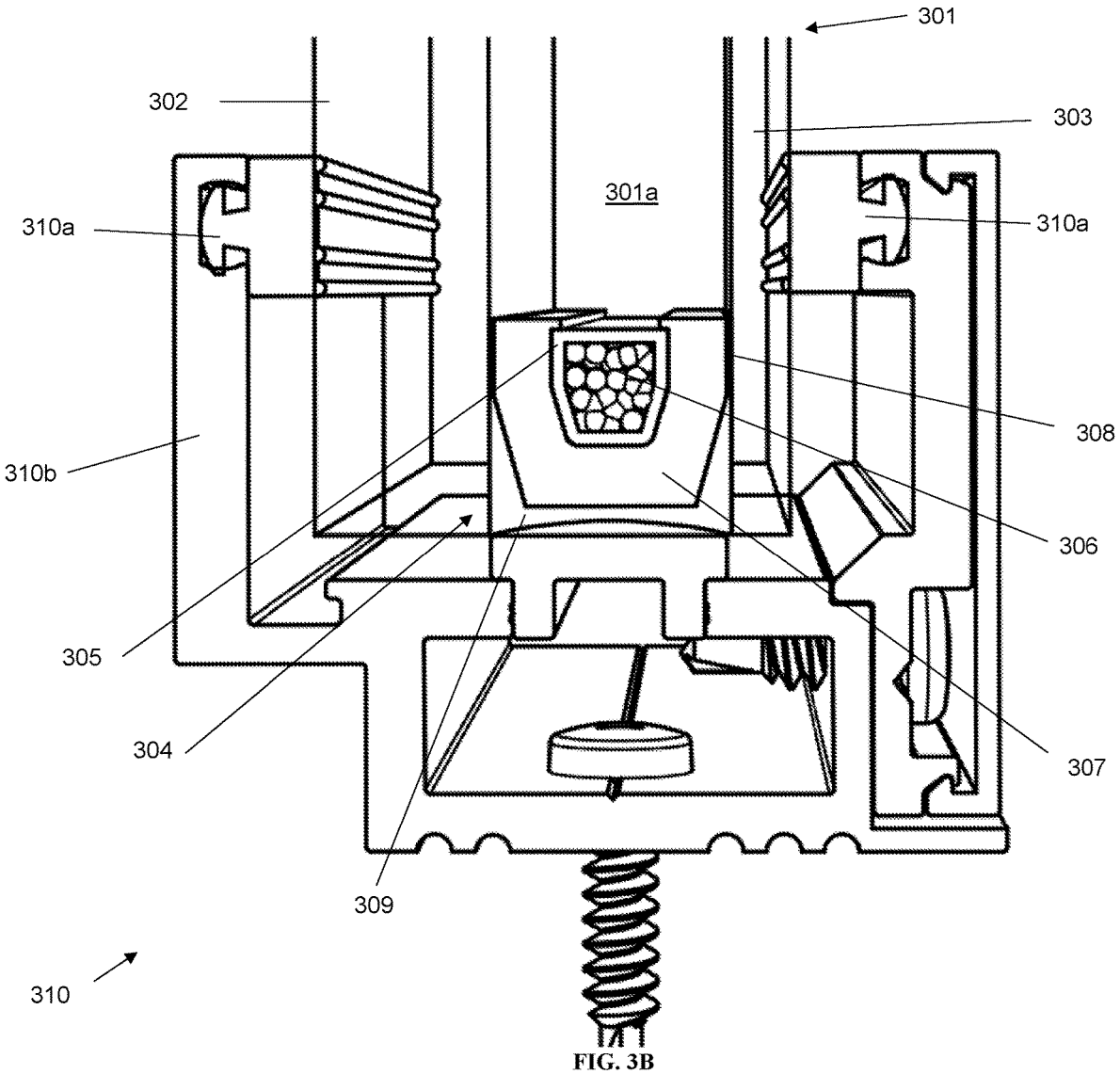

An additional component of the spacer bar 204 provided in later figures is a perimeter guard, such as perimeter guard 309 from FIG. 3A. This perimeter guard may be disposed on the outer surface of the spacer bar 204, such that said perimeter guard is almost parallel with the outward facing surfaces of each lite, as seen in FIGS. 3A-3B, and is exposed to the external environment. The perimeter guard may be provided as a liquid silicone or butyl filler consistent with other insulative materials used in the industry. Said perimeter guard material may conform to the shape of the gap formed between the inner lite, outer lite and the outer housing before drying, as seen in FIG. 3A, thus further sealing the formed IGU cavity. The perimeter guard may be comprised of a base surface, such as base surface 309*a* of FIG. 3A, disposed between two side ridges, such as side ridge 309*b* of FIG. 3A. As a result of being applied as a liquid, the shape of the perimeter guard may be a result of the surrounding structures. The perimeter guard is configured such that the outer housing 207 may be seated within it, resulting in the base surface coming into direct contact with the outer housing base 207*b* of the outer housing 207. After application, the perimeter guard may solidify and adhere the inner lite, outer lite and outer housing 207 together into a unified structure, further sealing the formed IGU cavity. The perimeter guard 309 may be disposed on the outer perimeter of the spacer bar 204, such that it may effectively interconnect the outer housing 207 to each lite to seal the formed IGU cavity. Much like the outer housing 207, the perimeter guard 309 may be flexible and capable of providing shock absorption to the IGU, such that both the perimeter guard 309 and outer housing 207 react flexibly to an impact to the outer lite to maintain their engagement with each other.

As described hereinabove, the inner housing 205 may have a hexagonally shaped body with a narrower bottom surface 205*c* and a wider top surface 205*d*. The hexagonally shaped body may be further comprised of two upper side surfaces 205*e* connected to the wider top surface 205*d*, wherein the two upper side surfaces 205*e* are parallel with each other and perpendicular with the wider top surface 205*d*, and two lower side surfaces 205*f*, each of which connects a corresponding upper side surface 205*e* to a corresponding end of the narrower bottom surface 205*c*. Much like outer housing 207, the inner housing 205 may also be described as tapered, due to its narrower bottom surface 205*c* and wider top surface 205*d* As a result of inner housing slot 207*c* of the outer housing 207 being configured to secure the inner housing 205, each outer housing leg 207*a* may be comprised of a straight section 207*e* configured to contact a corresponding upper side surface 205*e*, and an angled section 207*f* configured to contact a corresponding lower side surface 205*f*. The perimeter guard 309 is configured to engage with the outer housing 207 such that each side ridge 309*b* of the perimeter guard contacts a corresponding angled section 207*f* of the outer housing 207, while the base surface 309*a* is configured to contact the outer housing base 207*b*. Each spacer strip 208 is configured to be confined between the straight section 207*e* of one of the outer housing legs 207*a* and a corresponding lite. As can be seen in FIG. 3A, the shapes of the various components of the spacer bar 204 are configured to engage with each other in order to ensure an airtight seal between the inner lite and outer lite of the Riot Glass IGU. While this specific embodiment of the spacer bar 204 shown in FIG. 2 may implement components having the unique shapes and interlocking configuration described above, similar components having suitably corresponding shapes to ensure the proper engagement of spacer bar 204 components and the airtight sealing of the IGU cavity may be utilized in order to achieve the same goals.

As a result of the hexagonal shape of the inner housing 205, and the need to provide an outer housing 207 having a uniform thickness, the outer housing 207 may have a shape similar to that of the inner housing 205. One benefit of this is that this shape of the outer housing 207 creates a larger contact surface area between the outer housing 207 and the perimeter guard. The shape of the outer housing 207 also allows the perimeter guard to have a large contact area with each lite, thus further securing the inner lite, outer lite and outer housing 207 to each other, as well as the perimeter guard, thus forming a secure, and structurally stable IGU. The adherent properties of the perimeter guard should prove sufficient to suitably maintain the IGU cavity formed between the inner lite and outer lite even in the event of a forced entry attempt from the outer lite side of the IGU.

In an alternative embodiment, the spacer bar 204 may utilize a square inner housing, nested within an outer housing having correspondingly straight outer housing legs. The outer housing may contact a flat perimeter guard disposed on the exterior surface of the alternative spacer bar. This alternative embodiment may utilize taller spacer strips disposed between each lite and the outer housing in order to compensate for the absence of the side ridges 309*b* on the perimeter guard 309 of the previous embodiment. Other component shapes and configurations may be used as well, but the initially described embodiment depicted through FIG. 1-FIG. 5 may be preferred for having increased engagement area between the perimeter guard 209, the inner lite, the outer lite and the outer housing 207, which helps to keep the IGU together and the formed IGU cavity insulated.

FIG. 3A and FIG. 3B illustrate the cross-sectional views of a mounted Riot Glass security IGU 301, according to an aspect. As described hereinabove, the components of the spacer bar 304, including the inner housing 305, desiccant 306, outer housing 307, spacer strips 308 and perimeter guard 309 are configured to engage with each other in order to facilitate an airtight IGU cavity 301*a* and a unified IGU 301. The aforementioned desiccant ports 305*g* may be disposed within the inner housing 305 in order to facilitate the exposure of the internally disposed desiccant 306 to the IGU cavity 301*a* environment. By providing a desiccant 306 encased within the inner housing 305, alongside a plurality of desiccant ports 305*g* traveling through the inner housing 305 between the IGU cavity 301*a* and the desiccant chamber, fogging between the inner lite 303 and the outer lite 302 may be reduced or prevented by trapping moisture within the desiccant 306, while providing an airtight seal between the inner lite 303 and the outer lite 302 may prevent moisture from entering the cavity 301*a* altogether.

A mounting system 310 used to secure the Riot Glass IGU 301 to a mounting surface (not shown), may secure the IGU 301 through the utilization of one or more gaskets supported by the body of a mounting structure. In the present embodiment of FIG. 3A-3B, several gaskets are used, with a narrow gasket 310*a* configured to contact each lite of the IGU 301 from a perimeter portion of said lite, and a universal bottom gasket 310*e* configured to contact the spacer bar 304 of the IGU 301, such that the IGU 301 is sufficiently supported within the mounting system 310 from each side of the IGU 301. Alternative mounting systems may employ different quantities and types of gaskets, depending on the configuration of said mounting system 310, as well as the characteristics of the IGU 301.

The disclosed mounting system 310 may be a Gen. 2 ArmorPlast system ("ArmorPlast system", "AP system", "system"), wherein said mounting system 310 is configured to securely hold an IGU 301 or security panel in place, even in the event of a forced entry attempt. The disclosed Gen. 2 ArmorPlast system may be comprised of a base mount 310*b* configured to hold a narrow gasket 310*a* and a universal bottom gasket 310*e*, a pressure plate 310*c* configured to hold an additional narrow gasket 310*a*, wherein the pressure plate 310*c* is configured to engage with the base mount 310*b* using a base screw 310*f* in order to secure the IGU 301 within the AP system 310. A snap cover 310*d* may be configured to engage with the pressure plate 310*c* in order to cover the base screw 310*f*, for both security and aesthetic purposes. The AP system 310 may be secured to a mounting surface (not shown) through the usage of at least one mounting screw 310*e* configured to secure the base mount 310*b* to said mounting surface. Other types of mounting systems may also be utilized as needed to secure the IGU 301 to the intended mounting surface, though the AP system may be preferred for its versatility, structural stability, and ease of use.

One of the main benefits of utilizing the Riot Glass IGU 301 having the described spacer bar 304 is that the said IGU 301 may be highly resistant to being crushed. The sturdy yet flexible construction of the spacer bar 304 may allow for the IGU to withstand a great force or impact to the outer lite 302 without either lite becoming dislodged or the spacer bar 304 being crushed. As described previously, the IGU 301 may be installed in a structure such that the high strength outer lite 302 is disposed on the exterior side of said structure, such that an individual attempting to break in to said structure would only be able to interact with a thicker, stronger outer lite 302 and not the inner lite 303. As a result of the crush resistant and shock absorbing spacer bar 304 disposed between the inner lite 303 and the outer lite 302, said individual may not be able to dislodge either lite though conventional means, therefore providing greatly improved resistance against break-in attempts. The disclosed spacer bar 304, when used in conjunction with a high strength, high durability outer lite 302, such as a polycarbonate panel, may provide an IGU 301 that greatly resists multiple know break-in methods used against IGUs, including crushing the spacer 304, and/or breaking the outer lite 302.

A critical aspect of the disclosed security specific shock absorbing spacer bar 304 is that it is capable of providing a shock absorbing inner structure to the outer lite 302 of the IGU 301. Instead of rigidly resisting an impact, which may result in the full force of an impact being imparted directly and solely upon the outer lite 302, the outer housing 307 of the spacer bar 304 may instead help to absorb some of the energy of an impact, such that the force experienced by the outer lite 302 is somewhat diminished and more evenly distributed within the IGU 301. The outer housing 307 may be made of a foam-like synthetic rubber, such as closed cell EPDM (ethylene propylene diene monomer) rubber, or another suitable material that may allow the spacer bar 304 to flexibly absorb the shock of an impact on the outer lite 302.

Figure 4:
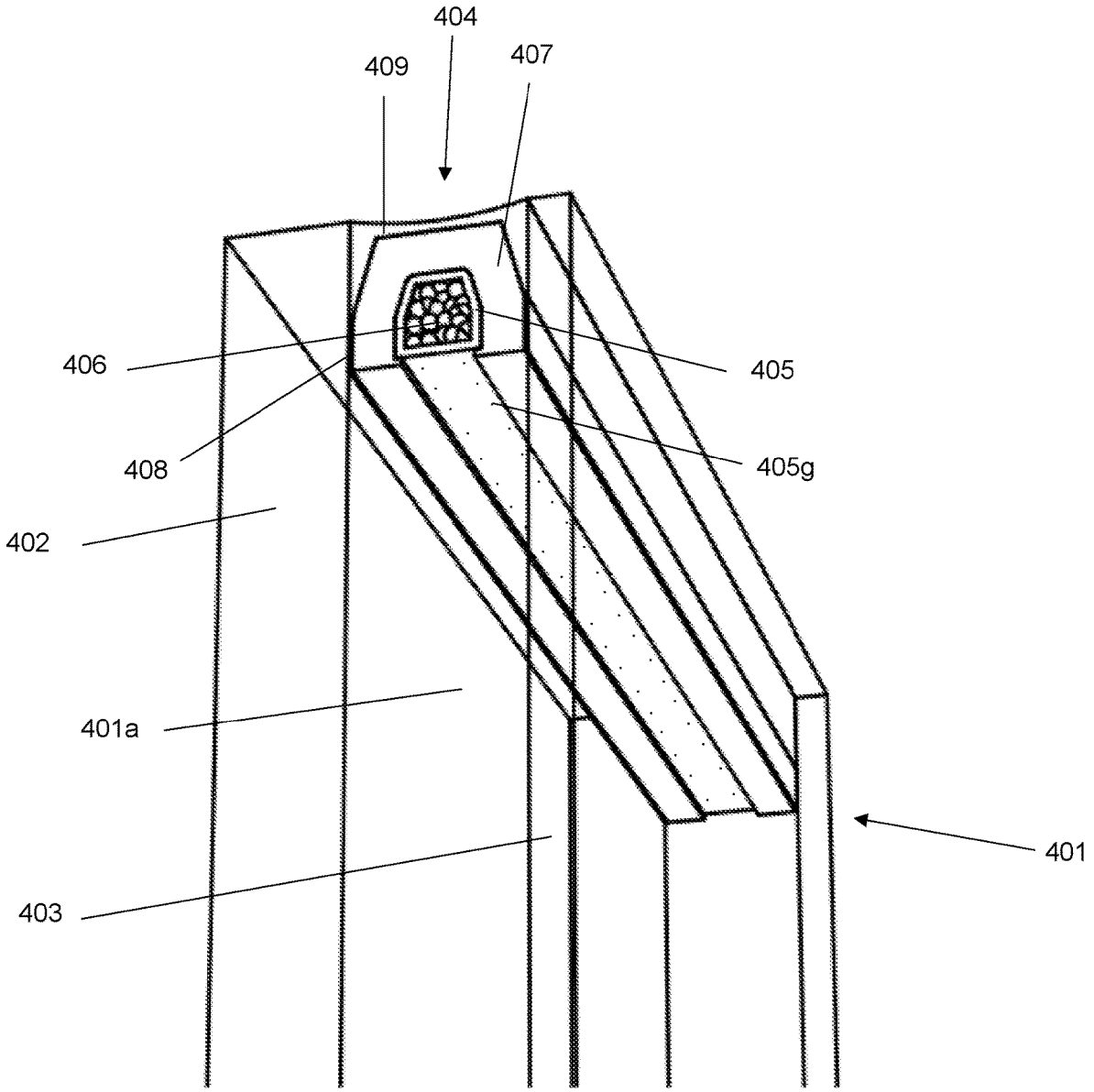
FIG. 4 illustrates the cross-sectional view of a top portion of a two lite Riot Glass security IGU, according to an aspect.

FIG. 4 illustrates the cross-sectional view of a top portion of a Riot Glass security IGU 401, according to an aspect. As described previously, the inner lite 403 and the outer lite 402 may have the same dimensions, with the exception of their thicknesses, wherein the outer lite 402 may be thicker than the inner lite 403 in order to provide protection on the IGU surface expected to receive direct damage from an individual attempting to gain unauthorized access. This may entail positioning the outer lite 402 on the inside of a structure, in cases in which a break-out attempt may be performed from the inside the structure. The thicker outer lite 402 may be placed on whichever side of a structure that unauthorized entry/exit attempts would be made. While two edges of the RG IGU 101 are shown in FIG. 1, and only one edge of the RG IGU 301, 401 is shown in FIG. 3A-FIG. 4, it may be assumed that for an RG IGU configured to fit within a standard, rectangular window, said IGU 401 would have a rectangular prism shape, with four perimeter faces, each of which has a length of spacer bar 404 disposed between corresponding perimeter portions of an inner lite 403 and an outer lite 402. As described previously, the two largest faces of the IGU 401 would corresponding to the viewing surfaces of the IGU 401.

A notable benefit of providing a thicker, higher strength outer lite 402 with a thinner glass inner lite 403 in the same IGU 401 is that said IGU 401 may be able to have a dual lite IGU assembly with an optimally minimized thickness. If a both the inner lite and outer lite were provided in a greater thickness, the overall thickness of the IGU may be too great to fit within certain mounting systems, whereas if both the inner lite and outer lite were provided in a lesser thickness, it may compromise the strength of the outer lite. By having a thicker outer lite 402 and a thinner inner lite 403, the thickness of the IGU may be made more manageable, while providing a high strength lite on the IGU surface that would experience direct damage from an unauthorized entry attempt.

An embodiment of the disclosed Riot Glass IGU may utilize a 1" thick polycarbonate panel as the outer lite 402 and a "¼ thick laminated glass pane as the inner lite 403. The 1" thick polycarbonate panel has excellent strength properties and will greatly resist being broken by direct impacts. While the polycarbonate outer lite 402 may become scratched or scored as a result of being struck or otherwise attacked by an individual attempting to break it, the scratches/scores may not be highly visible and may only affect the appearance of said outer lite 402, allowing the owner to replace the outer lite at their leisure without compromising security. In contrast, the glass inner lite 403 may not be highly resistant to impacts, as this side of the IGU cannot be directly accessed by said individual attempting to gain unauthorized access, and thus may not need said quality. This glass inner lite 403, however, may be resistant to being scratched or scored by the light wear and tear, consistent with light accidental impacts, which will likely prove sufficient for protecting breakage of the glass inner lite 403 from the corresponding side of the IGU 401. Additionally, this glass substrate of the glass inner lite 403 may be provided with certain desirable characteristics, such as low-E (low emissivity), low iron, tinting, one way mirror and energy efficiency features, which are not compatible with the polycarbonate panel. Alternative embodiments of the IGU 401 may have a total thickness of 1" and may utilize a ¼" thick polycarbonate panel as the outer lite 402.

The Riot Glass IGU 401 described hereinabove provides a window glazing solution with numerous unique benefits. The usage of this singular, self-contained IGU may allow for the utilization of a multi-lite assembly within a mounting surface having restrictive access or that would not normally be conducive to the addition of a secondary glazing, such as a narrow mounting surface. By providing this dual lite IGU 401 as a singular piece, only a singular mounting position may be needed to secure said IGU 401. The installation of this singular IGU 401 to said mounting surface may utilize a preexisting glazing slot, if possible, or a supplemental mounting system, such as a Gen 2 ArmorPlast mounting system, as seen in FIG. 3A-3B, as applicable. This unified IGU 401 may be integrated into a structure while maintaining its uniform design aesthetic, as if the structure the IGU 401 is installed within and the IGU 401 itself were intentionally designed be used together. The usage of this IGU within a window frame, door frame or other structure may enhance said structure's insulative properties, as a result of the thickness of the IGU, as well as an insulative gas, such as argon gas, stored between its inner lite 403 and outer lite 402. By providing a thicker, breakage resistant outer lite 402 and a thinner, specialty coating compatible inner lite 403, the overall thickness of the IGU may be minimized while simultaneously optimizing the IGUs breakage resistance from the only surface that a would-be intruder can access. The shock absorbing spacer bar 404 disposed between the inner lite 403 and the outer lite 402 may be highly resistant to being crushed, preventing said intruder from gaining access by crushing the spacer bar 404 to dislodge outer lite 402, while simultaneously providing a concealed, internal location to store a desiccant 406 for humidity maintenance within the IGU cavity 401*a*.

The manufacturing process for the IGU may first begin with the cutting of the outer lite 402 into the desired size for an application, and the production of the outer housing 407 through suitable manufacturing methods. The outer housing 407 and outer lite 402 may then be provided to a secondary manufacturer that provides the remainder of the components and assembles the IGU accordingly. The secondary manufacturer may cut a glass inner lite 403 such that it is the same length and height as the outer lite 402, wherein its width would correspond to its thickness, which may differ between inner lite and outer lite. The secondary manufacturer may then prepare for assembly by cleaning the inner lite 403 and outer lite 402 as needed. The secondary manufactured may insert a desiccant 406 filled inner housing 405 into the provided outer housing 407 before using the adhesive spacer strips 408 to combine the components as described above. Upon combination of the inner lite 403, outer lite 402 and the outer housing 407 using the spacer strips 408, the secondary manufacturer may apply the perimeter guard 409 as a liquid as described above and allow it to dry and adhere to secure the IGU 401 together.

Figure 5:
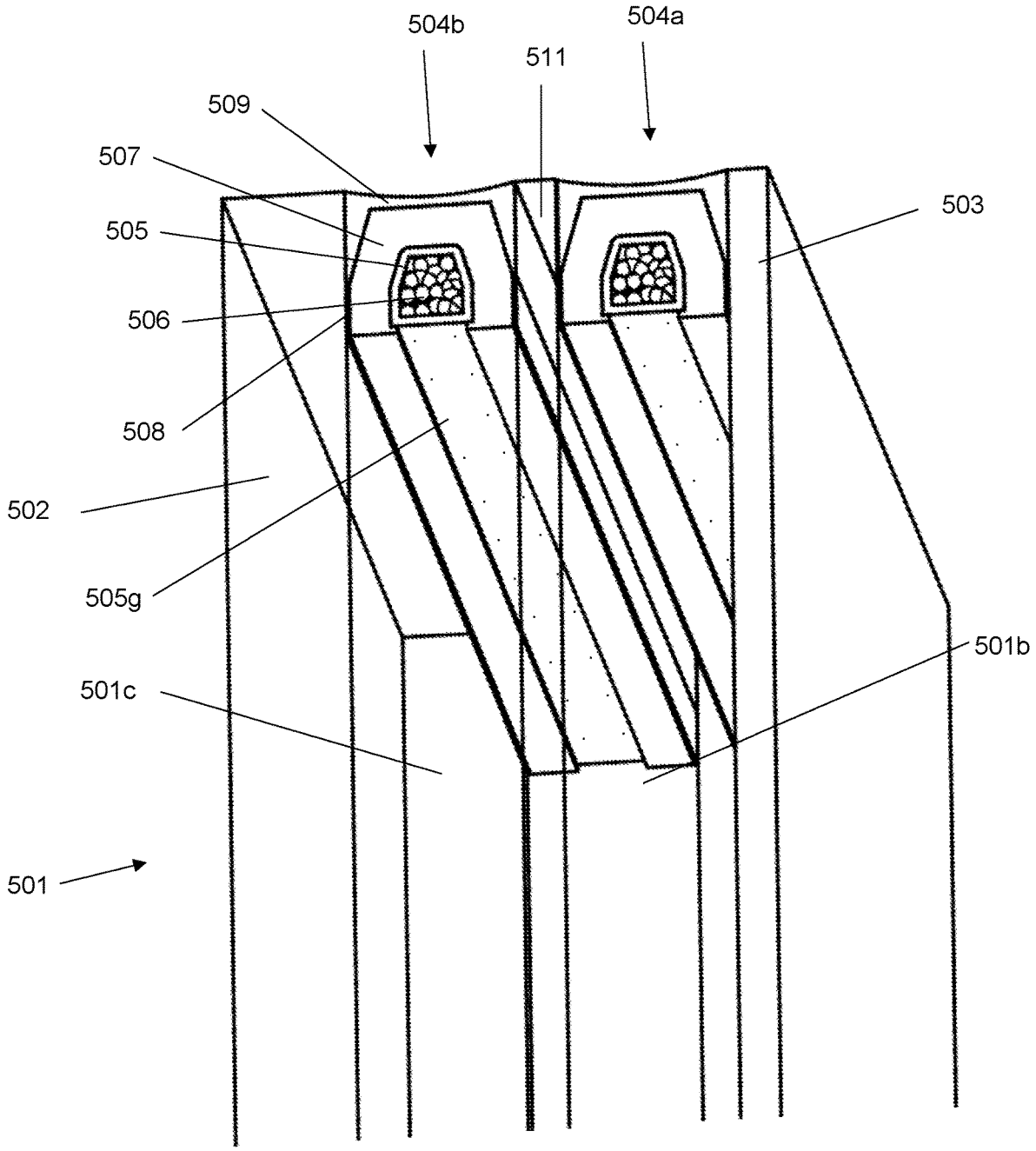
FIG. 5 illustrates the cross-sectional view of a top portion of a three lite Riot Glass security IGU, according to an aspect.

FIG. 5 illustrates the cross-sectional view of a top portion of a three lite Riot Glass security IGU, according to an aspect. While all embodiments depicted within this application prior to FIG. 5 may only show a singular spacer bar disposed between an inner lite 403 and an outer lite 402, the same spacer bar 404 may also be utilized in IGUs having additional lites. For example, an IGU may have three separate lites: an inner lite 503, an outer lite 502, and a middle lite 511 disposed between them. Such a triple lite IGU 500 may utilize two of the disclosed security specific shock absorbing spacer bar, with a first spacer bar 504*a* disposed between the inner lite 503 and the middle lite 511, and a second spacer bar 504*b* disposed between the middle lite and the outer lite. The interconnection of each spacer bar with each corresponding lite may be suitably equivalent to the interconnection described above for the dual lite IGU 401 in FIG. 4, with an adhesive spacer strip 508 configured to adhere each outer housing 507 to each adjacent lite and a corresponding perimeter guard 509 configured to further secure the outer housings 507 to each corresponding lite. This triple lite IGU assembly may exhibit similar benefits to the hereinabove described dual lite IGU assemblies, wherein spacer bars may help to absorb the shock of an impact imparted upon the outer lite. Such a triple lite IGU 501 may be useful in applications that require superior insulation to a dual lite IGU 401, while still requiring the increased security measures of an IGU 501 that utilizes the disclosed shock absorbing spacer bar.

As a result of the middle lite 511 not being exposed to direct impacts from an external force, it may be provided as a glass lite with a thickness comparable to that of the prior discussed inner lite 503. Both the inner lite 503 and the outer lite 502 of a three lite IGU may be the same as their equivalents in a two lite IGU. Certain modifications to the thicknesses of each lite and spacer bar may also be implemented, in order to optimize the thickness of the IGU 501 to facilitate its usage in a desired mounting system or within a specific structure. The three lite IGU may also have two separate IGU cavities; an inner IGU cavity ("inner cavity") 501*b* disposed between the inner lite and the middle lite and an outer IGU cavity ("outer cavity") 501*c* disposed between the middle lite and the outer lite. Much like the IGU cavity 401*a* of a two lite IGU 401, the inner cavity 501*b* and the outer cavity 501*c* may have their humidity maintained by desiccants 506 encased within corresponding spacer bars. As can be seen from FIG. 4 and FIG. 5, the components used in the two lite IGU and the three lite IGU may be the same and utilize the same interconnection methods described hereinabove, wherein the three lite IGU 501 may simply add an additional spacer bar and lite to the existing two lite IGU 401.

For the purposes of clarity, the components of the first spacer bar 504*a* may each be referred to using the term "first", whereas components of the second spacer bar may be referred to using the term "second". For example, a first spacer bar 504*a* may be disposed between perimeter portions of the inner lite 503 and the middle lite 511, wherein an inner cavity 501*b* is formed between the inner lite 503 and the middle lite 511, said first spacer bar 504*a* having: a first inner housing having a first desiccant chamber and a first plurality of desiccant ports disposed between the first desiccant chamber and the inner cavity; a first desiccant material encased within the first desiccant chamber; a first outer housing, wherein the first inner housing is configured to nest within the first outer housing; a first inner adhesive spacer strip configured to be confined between and adhered to the inner lite and the first outer housing of the first spacer bar; a first outer adhesive spacer strip configured to be confined between and adhered to the middle lite and the first outer housing of the first spacer bar; and a first perimeter guard disposed on a first outer perimeter of the first spacer bar, wherein the first perimeter guard is configured to adhere the first outer housing of the first spacer bar to the inner lite and the middle lite to seal the formed inner cavity.

Furthermore, a second spacer bar may be disposed between perimeter portions of the middle lite 511 and the outer lite 502, wherein an outer cavity 501*c* is formed between the middle lite 511 and the outer lite 502, said second spacer bar 504*b* having: a second inner housing having a second desiccant chamber and a second plurality of desiccant ports disposed between the second desiccant chamber and the second outer cavity; a second desiccant material encased within the second desiccant chamber; a second outer housing, wherein the second inner housing is configured to nest within the second outer housing; a second outer adhesive spacer strip configured to be confined between and adhered to the outer lite and the second outer housing of the second spacer bar; a second inner adhesive spacer strip configured to be confined between and adhered to the middle lite and the second outer housing of the second spacer bar; and a second perimeter guard disposed on a second outer perimeter of the second spacer bar, wherein the second perimeter guard is configured to adhere the second outer housing of the second spacer bar to the middle lite and the outer lite to seal the formed outer cavity. While many elements of the three lite IGU may utilize the "first" and "second" labelling to properly correlate them to their corresponding spacer bar, each element from the first spacer bar and the second spacer bar may be structurally identical.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

Claim limitations should be construed as means-plus-function limitations only if the claim recites the term "means" in association with a recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A security insulated glass unit comprising:

an inner lite;

an outer lite; and a shock absorbing spacer bar secured between perimeter portions of the inner lite and the outer lite, wherein a cavity is formed between the inner lite and the outer lite, the shock absorbing spacer bar comprising:

an inner housing having a top surface and a bottom surface, wherein the top surface is wider than the bottom surface, two upper side surfaces, each upper side surface connected to an opposite side of the top surface, two lower side surfaces, each lower side surface connected to an opposite side of the bottom surface and a corresponding upper side surface, wherein the top surface, the two upper side surfaces, the two lower side surfaces and the bottom surface form a tapered hexagonally shaped body, and the top surface and the bottom surface are parallel with each other; a desiccant chamber encased within the tapered hexagonally shaped body, and a plurality of desiccant ports that travel through the top surface;

a desiccant material encased within the desiccant chamber, wherein the desiccant material is exposed to the cavity through the plurality of desiccant ports;

an outer housing comprising an outer housing base disposed between two outer housing legs and an inner housing slot nested between said two outer housing legs, wherein each outer housing leg has of an angled section connected to the outer housing base, a straight section connected to the angled section and a locking ridge connected to the straight section, such that each locking ridge extends above the inner housing slot, and thus above the inner housing upon the inner housing nesting within the inner housing slot, wherein the outer housing has a tapered shape and the inner housing is configured to nest within the inner housing slot and be secured within the outer housing through direct engagement of the top surface with each locking ridge;

an inner adhesive spacer strip configured to be confined between and adhered to the inner lite and a corresponding straight section of the outer housing;

an outer adhesive spacer strip configured to be confined between and adhered to the outer lite and a corresponding straight section of the outer housing; and a perimeter guard disposed on an outer perimeter of the shock absorbing spacer bar, the perimeter guard having a base surface disposed between two side ridges, wherein the outer housing is configured to be seated within the perimeter guard such that the outer housing base is in contact with the base surface and each side ridge is in contact with a corresponding angled section and the perimeter guard is configured to adhere the outer housing to the inner lite and the outer lite to seal the cavity, wherein the outer lite is made of a breakage resistant material and the shock absorbing spacer bar is configured to absorb the shock of an impact to the outer lite and insulate the cavity.

2. The security insulated glass unit of claim 1, wherein the inner lite, outer lite, inner adhesive strip, outer adhesive strip, straight sections of the outer housing, and upper side surfaces of the inner housing are parallel with each other.

3. The security insulated glass unit of claim 1, wherein the outer housing is made of a shock absorbing material to prevent the shock absorbing spacer bar from being crushed during a forced entry attempt.

4. A security insulated glass unit comprising:

an inner lite;

a middle lite;

an outer lite;

a first spacer bar disposed between perimeter portions of the inner lite and the middle lite, wherein [an] a first inner cavity is formed between the inner lite and the middle lite, said first spacer bar having:

a first inner housing having a first desiccant chamber and a first plurality of desiccant ports disposed between the first desiccant chamber and the first inner cavity;

a first desiccant material encased within the first desiccant chamber;

a first outer housing, wherein the first inner housing is configured to nest within the first outer housing, the first outer housing having two first outer housing legs configured to engage with the first inner housing while leaving a top surface of the first inner housing substantially exposed to the first inner cavity;

a first inner adhesive spacer strip configured to be confined between and adhered to the inner lite and the first outer housing of the first spacer bar;

a first outer adhesive spacer strip configured to be confined between and adhered to the middle lite and the first outer housing of the first spacer bar; and a first perimeter guard disposed on a first outer perimeter of the first spacer bar, wherein the first perimeter guard is configured to adhere the first outer housing of the first spacer bar to the inner lite and the middle lite to seal the first inner cavity; and a second spacer bar disposed between perimeter portions of the middle lite and the outer lite, wherein [an] a second outer cavity is formed between the middle lite and the outer lite, said second spacer bar having:

a second inner housing having a second desiccant chamber and a second plurality of desiccant ports disposed between the second desiccant chamber and the second outer cavity;

a second desiccant material encased within the second desiccant chamber;

a second outer housing, wherein the second inner housing is configured to nest within the second outer housing, the second outer housing having two second outer housing legs configured to engage with the second inner housing while leaving a top surface of the second inner housing substantially exposed to the second outer cavity;

a second outer adhesive spacer strip configured to be confined between and adhered to the outer lite and the second outer housing of the second spacer bar;

a second inner adhesive spacer strip configured to be confined between and adhered to the middle lite and the second outer housing of the second spacer bar; and a second perimeter guard disposed on a second outer perimeter of the second spacer bar, wherein the second perimeter guard is configured to adhere the second outer housing of the second spacer bar to the middle lite and the outer lite to seal the second outer cavity, wherein the outer lite is made of a breakage resistant material and the first spacer bar and the second spacer bar are configured to absorb the shock of an impact to the outer lite and insulate the first inner cavity and second outer cavity, respectively.

5. The security insulated glass unit of claim 4, wherein the middle lite and the inner lite are made of glass and have the same thickness.

6. A security insulated glass unit comprising:

an inner lite;

an outer lite;

a spacer bar secured between the inner lite and the outer lite, wherein a cavity is formed between the inner lite and the outer lite, the spacer bar comprising:

an inner housing having a desiccant chamber and a plurality of desiccant ports disposed between the desiccant chamber and the cavity;

a desiccant material encased within the desiccant chamber;

an outer housing, wherein the inner housing is configured to nest within the outer housing and the outer housing is made of rubber;

an inner spacer strip configured to be confined between the inner lite and the outer housing;

an outer spacer strip configured to be confined between the outer lite and the outer housing; and a perimeter guard disposed on an outer perimeter of the spacer bar, wherein the perimeter guard is configured to adhere the outer housing to the inner lite and the outer lite to seal the cavity, wherein the outer lite is made of a breakage resistant material and the spacer bar is configured to absorb the shock of an impact to the outer lite and insulate the cavity.

7. The security insulated glass unit of claim 6, wherein the cavity contains an insulative gas.

8. The security insulated glass unit of claim 6, wherein the desiccant material is silica gel.

9. The security insulated glass unit of claim 6, wherein the outer lite is comprised of polycarbonate and has a greater thickness than the inner lite.

10. The security insulated glass unit of claim 6, wherein the outer lite is configured to be disposed on [the] an exterior surface of a structure and be directly impacted without breaking.

11. The security insulated glass unit of claim 6, wherein the inner lite is comprised of glass and has a lesser thickness than the outer lite, and the inner lite has a coating configured to reduce emissivity.

12. The security insulated glass unit of claim 6, wherein the inner spacer strip and the outer spacer strip are adhesive and adhere corresponding structures that [they] the inner spacer strip and the outer spacer strip are disposed between.

13. The security insulated glass unit of claim 6, wherein the spacer bar is configured to prevent the dislodging of the of the inner lite and the outer lite from the security insulated glass unit.

14. The security insulated glass unit of claim 6, wherein the security insulated glass unit is configured to be mounted within a window.

15. The security insulated glass unit of claim 6, wherein the inner housing is made of aluminum.

16. The security insulated glass unit of claim 6, wherein the outer housing is made of closed cell [EDPM] EPDM.

17. The security insulated glass unit of claim 6, wherein [the] shock absorption of the spacer bar is facilitated by the outer housing and the perimeter guard by both being made of a flexible material.

* * * * *